US009388584B2

(12) United States Patent
Pervan et al.

(10) Patent No.: US 9,388,584 B2
(45) **Date of Patent: *Jul. 12, 2016**

(54) MECHANICAL LOCKING SYSTEM FOR FLOOR PANELS

(71) Applicant: CERALOC INNOVATION AB, Viken (SE)

(72) Inventors: Darko Pervan, Viken (SE); Tony Pervan, Stockholm (SE)

(73) Assignee: CERALOC INNOVATION AB, Viken (SE)

( * ) Notice: Subject to any disclaimer, the term of this patent is extended or adjusted under 35 U.S.C. 154(b) by 0 days.

This patent is subject to a terminal disclaimer.

(21) Appl. No.: 14/701,959

(22) Filed: May 1, 2015

(65) Prior Publication Data

US 2015/0233125 A1 Aug. 20, 2015

Related U.S. Application Data

(63) Continuation of application No. 14/483,352, filed on Sep. 11, 2014, which is a continuation of application No. 13/585,179, filed on Aug. 14, 2012, now Pat. No. 8,857,126.

(60) Provisional application No. 61/523,584, filed on Aug. 15, 2011.

(51) Int. Cl.
*E04F 15/14* (2006.01)
*E04F 15/02* (2006.01)

(52) U.S. Cl.
CPC ..... *E04F 15/02038* (2013.01)

(58) Field of Classification Search
CPC ..... E04F 15/10; E04F 15/107; E04F 15/02; E04F 15/02005; E04F 15/02038; E04F 2201/103; E04F 2201/04; E04F 2201/041; E04F 2201/042; E04F 2201/043; E04F 2201/044; E04F 2201/045; E04F 2201/046
USPC ..... 52/390, 392, 533, 534, 539, 553, 578, 52/582.1, 586.1, 586.2, 588.1, 589.1, 52/590.2, 590.3, 591.1, 591.2, 591.4, 52/591.5, 592.1, 592.2, 592.4, 745.08, 52/745.49, 747, 747.11, 748.1, 748.11; 403/334, 345, 364–368, 372, 375, 376, 403/381; 404/68, 70; 428/44, 47–50, 57, 428/58, 60, 61, 106, 192–194
See application file for complete search history.

(56) References Cited

U.S. PATENT DOCUMENTS 87,853 A 3/1869 Kappes
108,068 A 10/1870 Utley
(Continued)

FOREIGN PATENT DOCUMENTS

CA 2456513 A1 2/2003
CN 201588375 U 9/2010
(Continued)

OTHER PUBLICATIONS

U.S. Appl. No. 14/646,567, Pervan.
(Continued)

*Primary Examiner* — William Gilbert
(74) *Attorney, Agent, or Firm* — Buchanan Ingersoll & Rooney P.C.

(57) ABSTRACT

Floor panels are shown, which are provided with a vertical locking system on short edges including a displaceable tongue that is displaced in one direction into a tongue groove during vertical displacement of two panels. Building panels provided with a locking system for vertical locking of a first and a second building panel by a vertical displacement of the panels relative each other, a displaceable tongue is in a sidewardly open displacement groove provided at an edge of a first panel, said tongue cooperates with a tongue groove provided at an adjacent edge of a second panel for locking the edge and the adjacent edge vertically.

14 Claims, 8 Drawing Sheets

(56) References Cited

U.S. PATENT DOCUMENTS

| | | | |
|---|---|---|---|
| 124,228 | A | 3/1872 | Stuart |
| 213,740 | A | 4/1879 | Conner |
| 274,354 | A | 3/1883 | McCarthy et al. |
| 316,176 | A | 4/1885 | Ransom |
| 634,581 | A | 10/1899 | Miller |
| 861,911 | A | 7/1907 | Stewart |
| 1,194,636 | A | 8/1916 | Joy |
| 1,723,306 | A | 8/1929 | Sipe |
| 1,743,492 | A | 1/1930 | Sipe |
| 1,809,393 | A | 6/1931 | Rockwell |
| 1,902,716 | A | 3/1933 | Newton |
| 2,026,511 | A | 12/1935 | Storm |
| 2,204,675 | A | 6/1940 | Grunert |
| 2,266,464 | A | 12/1941 | Kraft |
| 2,277,758 | A | 3/1942 | Hawkins |
| 2,430,200 | A | 11/1947 | Wilson |
| 2,596,280 | A | 5/1952 | Nystrom |
| 2,732,706 | A | 1/1956 | Friedman |
| 2,740,167 | A | 4/1956 | Rowley |
| 2,858,584 | A | 11/1958 | Gaines |
| 2,863,185 | A | 12/1958 | Riedi |
| 2,865,058 | A | 12/1958 | Andersson |
| 2,869,016 | A | 6/1959 | Warren |
| 3,023,681 | A | 3/1962 | Worson |
| 3,077,703 | A | 2/1963 | Bergstrom |
| 3,099,110 | A | 7/1963 | Spaight |
| 3,147,522 | A | 9/1964 | Schumm |
| 3,271,787 | A | 9/1966 | Clary |
| 3,325,585 | A | 6/1967 | Brenneman |
| 3,331,180 | A | 7/1967 | Vissing et al. |
| 3,378,958 | A | 4/1968 | Parks et al. |
| 3,396,640 | A | 8/1968 | Fujiwara |
| 3,512,324 | A | 5/1970 | Reed |
| 3,517,927 | A | 6/1970 | Kennel |
| 3,526,071 | A | 9/1970 | Watanabe |
| 3,535,844 | A | 10/1970 | Glaros |
| 3,572,224 | A | 3/1971 | Perry |
| 3,579,941 | A | 5/1971 | Tibbals |
| 3,720,027 | A | 3/1973 | Christensen |
| 3,722,379 | A | 3/1973 | Koester |
| 3,731,445 | A | 5/1973 | Hoffmann et al. |
| 3,742,669 | A | 7/1973 | Mansfeld |
| 3,760,547 | A | 9/1973 | Brenneman |
| 3,760,548 | A | 9/1973 | Sauer et al. |
| 3,778,954 | A | 12/1973 | Meserole |
| 3,849,235 | A | 11/1974 | Gwynne |
| 3,919,820 | A | 11/1975 | Green |
| 3,950,915 | A | 4/1976 | Cole |
| 3,994,609 | A | 11/1976 | Puccio |
| 4,007,994 | A | 2/1977 | Brown |
| 4,030,852 | A | 6/1977 | Hein |
| 4,037,377 | A | 7/1977 | Howell et al. |
| 4,041,665 | A | 8/1977 | de Munck |
| 4,064,571 | A | 12/1977 | Phipps |
| 4,080,086 | A | 3/1978 | Watson |
| 4,082,129 | A | 4/1978 | Morelock |
| 4,100,710 | A | 7/1978 | Kowallik |
| 4,104,840 | A | 8/1978 | Heintz et al. |
| 4,107,892 | A | 8/1978 | Bellem |
| 4,113,399 | A | 9/1978 | Hansen, Sr. et al. |
| 4,169,688 | A | 10/1979 | Toshio |
| 4,196,554 | A | 4/1980 | Anderson |
| 4,227,430 | A | 10/1980 | Jansson et al. |
| 4,299,070 | A | 11/1981 | Oltmanns |
| 4,304,083 | A | 12/1981 | Anderson |
| 4,426,820 | A | 1/1984 | Terbrack |
| 4,447,172 | A | 5/1984 | Galbreath |
| 4,512,131 | A | 4/1985 | Laramore |
| 4,599,841 | A | 7/1986 | Haid |
| 4,648,165 | A | 3/1987 | Whitehorne |
| 4,819,932 | A | 4/1989 | Trotter, Jr. |
| 5,007,222 | A | 4/1991 | Raymond |
| 5,026,112 | A | 6/1991 | Rice |
| 5,071,282 | A | 12/1991 | Brown |
| 5,135,597 | A | 8/1992 | Barker |
| 5,148,850 | A | 9/1992 | Urbanick |
| 5,173,012 | A | 12/1992 | Ortwein et al. |
| 5,182,892 | A | 2/1993 | Chase |
| 5,247,773 | A | 9/1993 | Weir |
| 5,272,850 | A | 12/1993 | Mysliwiec et al. |
| 5,274,979 | A | 1/1994 | Tsai |
| 5,295,341 | A | 3/1994 | Kajiwara |
| 5,344,700 | A | 9/1994 | McGath et al. |
| 5,348,778 | A | 9/1994 | Knipp et al. |
| 5,373,674 | A | 12/1994 | Winter, IV |
| 5,465,546 | A | 11/1995 | Buse |
| 5,485,702 | A | 1/1996 | Sholton |
| 5,502,939 | A | 4/1996 | Zadok et al. |
| 5,548,937 | A | 8/1996 | Shimonohara |
| 5,577,357 | A | 11/1996 | Civelli |
| 5,598,682 | A | 2/1997 | Haughian |
| 5,618,602 | A | 4/1997 | Nelson |
| 5,634,309 | A | 6/1997 | Polen |
| 5,658,086 | A | 8/1997 | Brokaw et al. |
| 5,694,730 | A | 12/1997 | Del Rincon et al. |
| 5,755,068 | A | 5/1998 | Ormiston |
| 5,860,267 | A | 1/1999 | Pervan |
| 5,899,038 | A | 5/1999 | Stroppiana |
| 5,950,389 | A | 9/1999 | Porter |
| 5,970,675 | A | 10/1999 | Schray |
| 6,006,486 | A | 12/1999 | Moriau |
| 6,029,416 | A | 2/2000 | Andersson |
| 6,052,960 | A | 4/2000 | Yonemura |
| 6,065,262 | A | 5/2000 | Motta |
| 6,173,548 | B1 | 1/2001 | Hamar et al. |
| 6,182,410 | B1 | 2/2001 | Pervan |
| 6,203,653 | B1 | 3/2001 | Seidner |
| 6,254,301 | B1 | 7/2001 | Hatch |
| 6,295,779 | B1 | 10/2001 | Canfield |
| 6,314,701 | B1 | 11/2001 | Meyerson |
| 6,332,733 | B1 | 12/2001 | Hamberger |
| 6,339,908 | B1 | 1/2002 | Chuang |
| 6,345,481 | B1 | 2/2002 | Nelson |
| 6,358,352 | B1 | 3/2002 | Schmidt |
| 6,363,677 | B1 | 4/2002 | Chen et al. |
| 6,385,936 | B1 | 5/2002 | Schneider |
| 6,418,683 | B1 | 7/2002 | Martensson et al. |
| 6,446,413 | B1 | 9/2002 | Gruber |
| 6,449,918 | B1 | 9/2002 | Nelson |
| 6,450,235 | B1 | 9/2002 | Lee |
| 6,490,836 | B1 | 12/2002 | Moriau et al. |
| 6,505,452 | B1 | 1/2003 | Hannig |
| 6,546,691 | B2 | 4/2003 | Leopolder |
| 6,553,724 | B1 | 4/2003 | Bigler |
| 6,576,079 | B1 | 6/2003 | Kai |
| 6,584,747 | B2 | 7/2003 | Kettler et al. |
| 6,591,568 | B1 | 7/2003 | Pålsson |
| 6,601,359 | B2 | 8/2003 | Olofsson |
| 6,617,009 | B1 | 9/2003 | Chen et al. |
| 6,647,689 | B2 | 11/2003 | Pletzer et al. |
| 6,647,690 | B1 | 11/2003 | Martensson |
| 6,651,400 | B1 | 11/2003 | Murphy |
| 6,670,019 | B2 | 12/2003 | Andersson |
| 6,681,820 | B2 | 1/2004 | Olofsson |
| 6,685,391 | B1 | 2/2004 | Gideon |
| 6,729,091 | B1 | 5/2004 | Martensson |
| 6,763,643 | B1 | 7/2004 | Martensson |
| 6,766,622 | B1 | 7/2004 | Thiers |
| 6,769,219 | B2 | 8/2004 | Schwitte et al. |
| 6,769,835 | B2 | 8/2004 | Stridsman |
| 6,802,166 | B1 | 10/2004 | Gerhard |
| 6,804,926 | B1 | 10/2004 | Eisermann |
| 6,808,777 | B2 | 10/2004 | Andersson et al. |
| 6,854,235 | B2 | 2/2005 | Martensson |
| 6,862,857 | B2 | 3/2005 | Tychsen |
| 6,865,855 | B2 | 3/2005 | Knauseder |
| 6,874,291 | B1 | 4/2005 | Weber |
| 6,880,307 | B2 | 4/2005 | Schwitte et al. |
| 6,948,716 | B2 | 9/2005 | Drouin |
| 7,021,019 | B2 | 4/2006 | Knauseder |
| 7,040,068 | B2 | 5/2006 | Moriau et al. |
| 7,051,486 | B2 | 5/2006 | Pervan |
| 7,108,031 | B1 | 9/2006 | Secrest |
| 7,121,058 | B2 | 10/2006 | Pålsson |

(56) References Cited

U.S. PATENT DOCUMENTS 7,152,383 B1 12/2006 Wilkinson et al.
7,188,456 B2 3/2007 Knauseder
7,219,392 B2 5/2007 Mullet et al.
7,251,916 B2 8/2007 Konzelmann et al.
7,257,926 B1 8/2007 Kirby
7,337,588 B1 3/2008 Moebus
7,377,081 B2 5/2008 Ruhdorfer
7,451,578 B2 11/2008 Hannig
7,454,875 B2 11/2008 Pervan et al.
7,516,588 B2 4/2009 Pervan
7,517,427 B2 4/2009 Sjoberg et al.
7,533,500 B2 5/2009 Morton et al.
7,556,849 B2 7/2009 Thompson et al.
7,568,322 B2 8/2009 Pervan
7,584,583 B2 9/2009 Bergelin et al.
7,614,197 B2 11/2009 Nelson
7,617,651 B2 11/2009 Grafenauer
7,621,092 B2 11/2009 Groeke et al.
7,634,884 B2 12/2009 Pervan
7,637,068 B2 12/2009 Pervan
7,654,055 B2 2/2010 Ricker
7,677,005 B2 3/2010 Pervan
7,716,889 B2 5/2010 Pervan
7,721,503 B2 5/2010 Pervan et al.
7,726,088 B2 6/2010 Muehlebach
7,757,452 B2 7/2010 Pervan
7,802,411 B2 9/2010 Pervan
7,806,624 B2 10/2010 McLean et al.
7,841,144 B2 11/2010 Pervan et al.
7,841,145 B2 11/2010 Pervan et al.
7,841,150 B2 11/2010 Pervan
7,856,789 B2 12/2010 Eisermann
7,861,482 B2 1/2011 Pervan et al.
7,866,110 B2 1/2011 Pervan
7,908,815 B2 3/2011 Pervan et al.
7,908,816 B2 3/2011 Grafenauer
7,930,862 B2 4/2011 Bergelin et al.
7,980,039 B2 7/2011 Groeke
7,980,041 B2 7/2011 Pervan
8,033,074 B2 10/2011 Pervan
8,042,311 B2 10/2011 Pervan
8,061,104 B2 11/2011 Pervan
8,079,196 B2 12/2011 Pervan
8,112,967 B2 2/2012 Pervan et al.
8,171,692 B2 5/2012 Pervan
8,181,416 B2 5/2012 Pervan et al.
8,191,334 B2 6/2012 Braun
8,234,830 B2 8/2012 Pervan et al.
8,281,549 B2 10/2012 Du
8,302,367 B2 11/2012 Schulte
8,336,272 B2 12/2012 Prager et al.
8,341,914 B2 1/2013 Pervan et al.
8,341,915 B2 1/2013 Pervan et al.
8,353,140 B2 1/2013 Pervan et al.
8,359,805 B2 1/2013 Pervan et al.
8,381,477 B2 2/2013 Pervan et al.
8,387,327 B2 3/2013 Pervan
8,448,402 B2 5/2013 Pervan et al.
8,499,521 B2 8/2013 Pervan et al.
8,505,257 B2 8/2013 Boo et al.
8,511,031 B2 8/2013 Bergelin et al.
8,528,289 B2 9/2013 Pervan et al.
8,544,230 B2 10/2013 Pervan
8,544,234 B2 10/2013 Pervan et al.
8,572,922 B2 11/2013 Pervan
8,578,675 B2 11/2013 Palsson et al.
8,596,013 B2 12/2013 Boo
8,615,952 B2 12/2013 Engström
8,627,862 B2 1/2014 Pervan et al.
8,631,623 B2 1/2014 Engström
8,640,424 B2 2/2014 Pervan et al.
8,650,826 B2 2/2014 Pervan et al.
8,677,712 B1 3/2014 Pervan
8,689,512 B2 4/2014 Pervan
8,707,650 B2 4/2014 Pervan
8,713,886 B2 5/2014 Boo et al.
8,733,065 B2 5/2014 Pervan
8,733,410 B2 5/2014 Pervan
8,763,341 B2 7/2014 Pervan
8,769,905 B2 7/2014 Pervan
8,776,473 B2 7/2014 Pervan et al.
8,844,236 B2 9/2014 Pervan et al.
8,857,126 B2 * 10/2014 Pervan et al. ..... 52/582.1
8,869,485 B2 10/2014 Pervan
8,887,468 B2 11/2014 Hakansson et al.
8,898,988 B2 12/2014 Pervan
8,925,274 B2 1/2015 Pervan et al.
8,938,929 B2 1/2015 Engström
8,959,866 B2 2/2015 Pervan
9,027,306 B2 5/2015 Pervan
9,051,738 B2 * 6/2015 Pervan et al.
9,068,360 B2 6/2015 Pervan
2001/0024707 A1 9/2001 Andersson et al.
2002/0031646 A1 3/2002 Chen et al.
2002/0069611 A1 6/2002 Leopolder
2002/0092263 A1 7/2002 Schulte
2002/0170258 A1 11/2002 Schwitte et al.
2002/0170259 A1 11/2002 Ferris
2002/0178674 A1 12/2002 Pervan
2002/0178680 A1 12/2002 Martensson
2002/0189190 A1 12/2002 Charmat et al.
2003/0009971 A1 1/2003 Palmberg
2003/0024199 A1 2/2003 Pervan et al.
2003/0037504 A1 2/2003 Schwitte et al.
2003/0084636 A1 5/2003 Pervan
2003/0094230 A1 5/2003 Sjoberg
2003/0101681 A1 6/2003 Tychsen
2003/0145549 A1 8/2003 Palsson et al.
2003/0180091 A1 9/2003 Stridsman
2003/0188504 A1 10/2003 Eisermann
2003/0196405 A1 10/2003 Pervan
2004/0016196 A1 1/2004 Pervan
2004/0031227 A1 2/2004 Knauseder
2004/0049999 A1 3/2004 Krieger
2004/0060255 A1 4/2004 Knauseder
2004/0068954 A1 4/2004 Martensson
2004/0123548 A1 7/2004 Gimpel et al.
2004/0128934 A1 7/2004 Hecht
2004/0139676 A1 7/2004 Knauseder
2004/0139678 A1 7/2004 Pervan
2004/0159066 A1 8/2004 Thiers et al.
2004/0168392 A1 9/2004 Konzelmann et al.
2004/0177584 A1 9/2004 Pervan
2004/0182033 A1 9/2004 Wernersson
2004/0182036 A1 9/2004 Sjoberg et al.
2004/0200175 A1 10/2004 Weber
2004/0211143 A1 10/2004 Hanning
2004/0244325 A1 12/2004 Nelson
2004/0250492 A1 12/2004 Becker
2004/0261348 A1 12/2004 Vulin
2005/0003132 A1 1/2005 Blix et al.
2005/0028474 A1 2/2005 Kim
2005/0050827 A1 3/2005 Schitter
2005/0160694 A1 7/2005 Pervan
2005/0166514 A1 8/2005 Pervan
2005/0205161 A1 9/2005 Lewark
2005/0210810 A1 9/2005 Pervan
2005/0235593 A1 10/2005 Hecht
2005/0252130 A1 11/2005 Martensson
2006/0053724 A1 3/2006 Braun et al.
2006/0070333 A1 4/2006 Pervan
2006/0101769 A1 5/2006 Pervan
2006/0156670 A1 7/2006 Knauseder
2006/0174577 A1 8/2006 O'Neil
2006/0236642 A1 10/2006 Pervan
2006/0260254 A1 11/2006 Pervan et al.
2007/0006543 A1 1/2007 Engström
2007/0011981 A1 1/2007 Eiserman
2007/0028547 A1 2/2007 Grafenauer
2007/0065293 A1 3/2007 Hannig
2007/0108679 A1 5/2007 Grothaus
2007/0151189 A1 7/2007 Yang
2007/0175156 A1 8/2007 Pervan et al.
2007/0193178 A1 8/2007 Groeke et al.

(56) References Cited

U.S. PATENT DOCUMENTS

| | | | |
|---|---|---|---|
| 2007/0209736 | A1 | 9/2007 | Deringor et al. |
| 2007/0214741 | A1 | 9/2007 | Llorens Miravet |
| 2008/0000185 | A1 | 1/2008 | Duernberger |
| 2008/0000186 | A1 | 1/2008 | Pervan et al. |
| 2008/0000187 | A1 | 1/2008 | Pervan et al. |
| 2008/0010931 | A1 | 1/2008 | Pervan et al. |
| 2008/0010937 | A1 | 1/2008 | Pervan et al. |
| 2008/0028707 | A1 | 2/2008 | Pervan |
| 2008/0034708 | A1 | 2/2008 | Pervan |
| 2008/0041008 | A1 | 2/2008 | Pervan |
| 2008/0066415 | A1 | 3/2008 | Pervan |
| 2008/0104921 | A1 | 5/2008 | Pervan et al. |
| 2008/0110125 | A1 | 5/2008 | Pervan |
| 2008/0134607 | A1 | 6/2008 | Pervan |
| 2008/0134613 | A1 | 6/2008 | Pervan |
| 2008/0134614 | A1 | 6/2008 | Pervan |
| 2008/0155930 | A1 | 7/2008 | Pervan et al. |
| 2008/0216434 | A1 | 9/2008 | Pervan |
| 2008/0216920 | A1 | 9/2008 | Pervan |
| 2008/0236088 | A1 | 10/2008 | Hannig et al. |
| 2008/0295432 | A1 | 12/2008 | Pervan et al. |
| 2009/0019806 | A1 | 1/2009 | Muehlebach |
| 2009/0064624 | A1 | 3/2009 | Sokol |
| 2009/0100782 | A1 | 4/2009 | Groeke et al. |
| 2009/0133353 | A1 | 5/2009 | Pervan et al. |
| 2009/0151290 | A1 | 6/2009 | Liu |
| 2009/0173032 | A1 | 7/2009 | Prager et al. |
| 2009/0193741 | A1 | 8/2009 | Cappelle |
| 2009/0193748 | A1 | 8/2009 | Boo et al. |
| 2009/0193753 | A1 | 8/2009 | Schitter |
| 2009/0217615 | A1 | 9/2009 | Engstrom |
| 2009/0308014 | A1 | 12/2009 | Muehlebach |
| 2010/0043333 | A1 | 2/2010 | Hannig |
| 2010/0083603 | A1 | 4/2010 | Goodwin |
| 2010/0170189 | A1 | 7/2010 | Schulte |
| 2010/0173122 | A1 | 7/2010 | Susnjara |
| 2010/0281803 | A1 | 11/2010 | Cappelle |
| 2010/0293879 | A1 | 11/2010 | Pervan et al. |
| 2010/0300031 | A1 | 12/2010 | Pervan et al. |
| 2010/0319290 | A1 | 12/2010 | Pervan |
| 2010/0319291 | A1 | 12/2010 | Pervan et al. |
| 2011/0016815 | A1 | 1/2011 | Yang |
| 2011/0030303 | A1 | 2/2011 | Pervan et al. |
| 2011/0041996 | A1 | 2/2011 | Pervan |
| 2011/0047922 | A1 | 3/2011 | Fleming, III |
| 2011/0088344 | A1 | 4/2011 | Pervan et al. |
| 2011/0088345 | A1 | 4/2011 | Pervan |
| 2011/0088346 | A1 | 4/2011 | Hannig |
| 2011/0131916 | A1 | 6/2011 | Chen |
| 2011/0154763 | A1 | 6/2011 | Bergelin et al. |
| 2011/0167750 | A1 | 7/2011 | Pervan |
| 2011/0167751 | A1 | 7/2011 | Engström |
| 2011/0173914 | A1 | 7/2011 | Engström |
| 2011/0197535 | A1 | 8/2011 | Baker et al. |
| 2011/0225922 | A1 | 9/2011 | Pervan et al. |
| 2011/0252733 | A1 | 10/2011 | Pervan |
| 2011/0271632 | A1 | 11/2011 | Cappelle et al. |
| 2011/0283650 | A1 | 11/2011 | Pervan et al. |
| 2012/0017533 | A1 | 1/2012 | Pervan et al. |
| 2012/0031029 | A1 | 2/2012 | Pervan et al. |
| 2012/0036804 | A1 | 2/2012 | Pervan |
| 2012/0055112 | A1 | 3/2012 | Engström |
| 2012/0124932 | A1 | 5/2012 | Schulte et al. |
| 2012/0151865 | A1 | 6/2012 | Pervan et al. |
| 2012/0174515 | A1 | 7/2012 | Pervan |
| 2012/0174520 | A1 | 7/2012 | Pervan |
| 2012/0174521 | A1 | 7/2012 | Schulte |
| 2012/0192521 | A1 | 8/2012 | Schulte |
| 2012/0279161 | A1 | 11/2012 | Håkansson et al. |
| 2012/0304590 | A1 | 12/2012 | Engström |
| 2013/0008117 | A1 | 1/2013 | Pervan |
| 2013/0008118 | A1 | 1/2013 | Baert et al. |
| 2013/0014463 | A1 | 1/2013 | Pervan |
| 2013/0019555 | A1 | 1/2013 | Pervan |
| 2013/0042562 | A1 | 2/2013 | Pervan |
| 2013/0042563 | A1 | 2/2013 | Pervan |
| 2013/0042564 | A1 | 2/2013 | Pervan et al. |
| 2013/0042565 | A1 | 2/2013 | Pervan |
| 2013/0047536 | A1 | 2/2013 | Pervan |
| 2013/0081349 | A1 | 4/2013 | Pervan et al. |
| 2013/0111845 | A1 | 5/2013 | Pervan |
| 2013/0145708 | A1 | 6/2013 | Pervan |
| 2013/0160391 | A1 | 6/2013 | Pervan et al. |
| 2013/0232905 | A2 | 9/2013 | Pervan |
| 2013/0239508 | A1 | 9/2013 | Pervan et al. |
| 2013/0263454 | A1 | 10/2013 | Boo et al. |
| 2013/0263547 | A1 | 10/2013 | Boo |
| 2013/0318906 | A1 | 12/2013 | Pervan et al. |
| 2014/0007539 | A1 | 1/2014 | Pervan et al. |
| 2014/0020324 | A1 | 1/2014 | Pervan |
| 2014/0033634 | A1 | 2/2014 | Pervan |
| 2014/0053497 | A1 | 2/2014 | Pervan et al. |
| 2014/0059966 | A1 | 3/2014 | Boo |
| 2014/0069043 | A1 | 3/2014 | Pervan |
| 2014/0090335 | A1 | 4/2014 | Pervan et al. |
| 2014/0109501 | A1 | 4/2014 | Pervan |
| 2014/0109506 | A1 | 4/2014 | Pervan et al. |
| 2014/0123586 | A1 | 5/2014 | Pervan et al. |
| 2014/0130437 | A1 | 5/2014 | Cappelle |
| 2014/0144096 | A1 | 5/2014 | Vermeulen et al. |
| 2014/0150369 | A1 | 6/2014 | Hannig |
| 2014/0190112 | A1 | 7/2014 | Pervan |
| 2014/0208677 | A1 | 7/2014 | Pervan et al. |
| 2014/0223852 | A1 | 8/2014 | Pervan |
| 2014/0237931 | A1 | 8/2014 | Pervan |
| 2014/0250813 | A1 | 9/2014 | Nygren et al. |
| 2014/0260060 | A1 | 9/2014 | Pervan et al. |
| 2014/0305065 | A1 | 10/2014 | Pervan |
| 2014/0366476 | A1 | 12/2014 | Pervan |
| 2014/0373478 | A2 | 12/2014 | Pervan et al. |
| 2014/0373480 | A1 | 12/2014 | Pervan et al. |
| 2015/0000221 | A1 | 1/2015 | Boo |
| 2015/0013260 | A1 | 1/2015 | Pervan |
| 2015/0059281 | A1 | 3/2015 | Pervan |
| 2015/0089896 | A2 | 4/2015 | Pervan et al. |
| 2015/0121796 | A1 | 5/2015 | Pervan |
| 2015/0167318 | A1 | 6/2015 | Pervan |
| 2015/0211239 | A1 | 7/2015 | Pervan |

FOREIGN PATENT DOCUMENTS

| | | | |
|---|---|---|---|
| DE | 2 159 042 | | 6/1973 |
| DE | 33 43 601 | A1 | 6/1985 |
| DE | 33 43 601 | C2 | 6/1985 |
| DE | 39 32 980 | A1 | 11/1991 |
| DE | 42 15 273 | A1 | 11/1993 |
| DE | 42 42 530 | A1 | 6/1994 |
| DE | 196 01 322 | A | 5/1997 |
| DE | 299 22 649 | U1 | 4/2000 |
| DE | 200 01 788 | U1 | 6/2000 |
| DE | 199 40 837 | A1 | 11/2000 |
| DE | 199 58 225 | A1 | 6/2001 |
| DE | 202 05 774 | U1 | 8/2002 |
| DE | 203 20 799 | U1 | 4/2005 |
| DE | 10 2004 055 951 | A1 | 7/2005 |
| DE | 10 2004 001 363 | A1 | 8/2005 |
| DE | 10 2005 002 297 | A1 | 8/2005 |
| DE | 10 2004 054 368 | A1 | 5/2006 |
| DE | 10 2006 057 491 | A1 | 6/2006 |
| DE | 10 2005 024 366 | a1 | 11/2006 |
| DE | 10 2006 024 184 | A1 | 11/2007 |
| DE | 10 2006 037 614 | B3 | 12/2007 |
| DE | 10 2007 018 309 | A1 | 8/2008 |
| DE | 10 2007 016 533 | A1 | 10/2008 |
| DE | 10 2007 032 885 | A1 | 1/2009 |
| DE | 10 2007 035 646 | A1 | 1/2009 |
| DE | 10 2007 049 792 | A1 | 2/2009 |
| DE | 10 2009 048 050 | B3 | 1/2011 |
| EP | 0 013 851 | A1 | 8/1980 |
| EP | 0 871 156 | A2 | 10/1998 |
| EP | 0 974 713 | A1 | 1/2000 |
| EP | 1 120 515 | A1 | 6/2001 |
| EP | 1 146 182 | A2 | 10/2001 |
| EP | 1 350 904 | A2 | 10/2003 |

(56) References Cited

FOREIGN PATENT DOCUMENTS

| | | | |
|---|---|---|---|
| EP | 1 350 904 | A3 | 10/2003 |
| EP | 1 420 125 | A2 | 5/2004 |
| EP | 1 437 457 | A2 | 7/2004 |
| EP | 1 640 530 | A2 | 3/2006 |
| EP | 1 650 3785 | A1 | 4/2006 |
| EP | 1 650 375 | A2 | 9/2006 |
| EP | 1 980 683 | A2 | 10/2008 |
| EP | 2 000 610 | A1 | 12/2008 |
| EP | 2 017 403 | A2 | 1/2009 |
| EP | 2 034 106 | A1 | 3/2009 |
| EP | 2 333 195 | A1 | 6/2011 |
| EP | 2 333 195 | B1 | 7/2014 |
| FR | 1 138 595 | | 6/1957 |
| FR | 2 256 807 | | 8/1975 |
| FR | 2 810 060 | A1 | 12/2001 |
| GB | 240629 | | 10/1925 |
| GB | 376352 | | 7/1932 |
| GB | 1171337 | | 11/1969 |
| GB | 2 051 916 | A | 1/1981 |
| JP | 03-11025 | A | 5/1991 |
| JP | 05-018028 | A | 1/1993 |
| JP | 6-146553 | A | 5/1994 |
| JP | 6-288017 | A | 10/1994 |
| JP | 6-306961 | A | 11/1994 |
| JP | 6-322848 | A | 11/1994 |
| JP | 7-300979 | A | 11/1995 |
| SE | 526 688 | C2 | 5/2005 |
| SE | 529 076 | C2 | 4/2007 |
| WO | WO 94/26999 | A1 | 11/1994 |
| WO | WO 96/23942 | A1 | 8/1996 |
| WO | WO 96/27721 | A1 | 9/1996 |
| WO | WO 97/47834 | A1 | 12/1997 |
| WO | WO 98/21428 | A1 | 5/1998 |
| WO | WO 98/22677 | A1 | 5/1998 |
| WO | WO 98/58142 | A1 | 12/1998 |
| WO | WO 99/66151 | A1 | 12/1999 |
| WO | WO 99/66152 | A1 | 12/1999 |
| WO | WO 00/20705 | A1 | 4/2000 |
| WO | WO 00/20706 | A1 | 4/2000 |
| WO | WO 00/43281 | A2 | 7/2000 |
| WO | WO 00/47841 | A1 | 8/2000 |
| WO | WO 00/55067 | A1 | 9/2000 |
| WO | WO 01/02670 | A1 | 1/2001 |
| WO | WO 01/02671 | A1 | 1/2001 |
| WO | WO 01/02672 | A1 | 1/2001 |
| WO | WO 01/07729 | A1 | 2/2001 |
| WO | WO 01/38657 | A1 | 5/2001 |
| WO | WO 01/44669 | A2 | 6/2001 |
| WO | WO 01/44669 | A3 | 6/2001 |
| WO | WO 01/48331 | A1 | 7/2001 |
| WO | WO 01/48332 | A1 | 7/2001 |
| WO | WO 01/51732 | A1 | 7/2001 |
| WO | WO 01/51733 | A1 | 7/2001 |
| WO | WO 02/055809 | A1 | 7/2001 |
| WO | WO 01/75247 | A1 | 10/2001 |
| WO | WO 01/77461 | A1 | 10/2001 |
| WO | WO 01/02669 | A1 | 11/2001 |
| WO | WO 01/98604 | A1 | 12/2001 |
| WO | WO 02/48127 | | 6/2002 |
| WO | WO 02/055810 | A1 | 7/2002 |
| WO | WO 02/081843 | A1 | 10/2002 |
| WO | WO 02/103135 | A1 | 12/2002 |
| WO | WO 03/012224 | A1 | 2/2003 |
| WO | WO 03/016654 | A1 | 2/2003 |
| WO | WO 03/025307 | A1 | 3/2003 |
| WO | WO 03/038210 | A1 | 5/2003 |
| WO | WO 03/044303 | A1 | 5/2003 |
| WO | WP 03/069094 | A1 | 8/2003 |
| WO | WO 03/074814 | A1 | 9/2003 |
| WO | WO 03/063234 | A1 | 10/2003 |
| WO | WO 03/087497 | A1 | 10/2003 |
| WO | WO 03/089736 | A1 | 10/2003 |
| WO | WO 2004/016877 | A1 | 2/2004 |
| WO | WO 2004/020764 | A1 | 3/2004 |
| WO | WO 2004/048716 | A1 | 6/2004 |
| WO | WO 2004/050780 | A2 | 6/2004 |
| WO | WO 2004/079130 | A1 | 9/2004 |
| WO | WO 2004/083557 | A1 | 9/2004 |
| WO | WO 2004/085765 | A1 | 10/2004 |
| WO | WO 2005/003488 | A1 | 1/2005 |
| WO | WO 2005/003489 | A1 | 1/2005 |
| WO | WO 2005/054599 | A1 | 6/2005 |
| WO | WO 2006/043893 | A1 | 4/2006 |
| WO | WO 2006/050928 | A1 | 5/2006 |
| WO | WO 2006/104436 | A1 | 10/2006 |
| WO | WO 2006/123988 | A1 | 11/2006 |
| WO | WO 2006/125646 | A1 | 11/2006 |
| WO | WO 2007/015669 | A2 | 2/2007 |
| WO | WO 2007/019957 | A1 | 2/2007 |
| WO | WO 2007/079845 | A1 | 7/2007 |
| WO | WO 2007/089186 | A1 | 8/2007 |
| WO | WO 2007/118352 | A1 | 10/2007 |
| WO | WO 2007/141605 | A2 | 12/2007 |
| WO | WO 2007/142589 | A1 | 12/2007 |
| WO | WO 2008/004960 | A2 | 1/2008 |
| WO | WO 2008/004960 | A8 | 1/2008 |
| WO | WO 2008/017281 | A1 | 2/2008 |
| WO | WO 2008/017301 | A2 | 2/2008 |
| WO | WO 2008/017301 | A3 | 2/2008 |
| WO | WO 2008/060232 | A1 | 5/2008 |
| WO | WO 2008/068245 | A1 | 6/2008 |
| WO | WO 2009/013590 | A2 | 1/2009 |
| WO | WO 2009/066153 | A2 | 5/2009 |
| WO | WO 2009/116926 | A1 | 9/2009 |
| WO | WO 2010/006684 | A2 | 1/2010 |
| WO | WO 2010/070472 | A2 | 6/2010 |
| WO | WO 2010/070605 | A2 | 6/2010 |
| WO | WO 2010/082171 | A2 | 7/2010 |
| WO | WO 2010/087752 | A1 | 8/2010 |
| WO | WO 2010/105732 | A1 | 9/2010 |
| WO | WO 2010/108980 | A1 | 9/2010 |
| WO | WO 2010/136171 | A1 | 12/2010 |
| WO | WO 2011/001326 | A2 | 1/2011 |
| WO | WO 2011/012104 | A2 | 2/2011 |
| WO | WO 2011/032540 | A2 | 3/2011 |
| WO | WO 2011/038709 | A1 | 4/2011 |
| WO | WO 2011/085788 | A1 | 7/2011 |
| WO | WO 2011/127981 | A1 | 10/2011 |
| WO | WO 2011/151758 | A2 | 12/2011 |
| WO | WO 2013/025164 | A1 | 2/2013 |

OTHER PUBLICATIONS

U.S. Appl. No. 14/730,691, Pervan.

U.S. Appl. No. 14/709,913, Derelov.

International Search Report mailed Oct. 30, 2012 in PCT/SE2012/050872, Swedish Patent Office, Stockholm, Sweden, 5 pages.

Välinge Innovation AB, Technical Disclosure entitled "Mechanical locking for floor panels with a flexible bristle tongue," IP.com No. IPCOM000145262D, Jan. 12, 2007, IP.com PriorArtDatabase, 57 pages.

Engstrand, Ola (Contact)/Välinge Innovation AB, Technical Disclosure entitled "VA-038 Mechanical Locking of Floor Panels With Vertical Folding," IP com No. IPCOM000179246D, Feb. 10, 2009, IP.com Prior Art Database; 59 pages.

Engstrand, Ola (Contact)/Välinge Innovation AB, Technical Disclosure entitled "VA043 5G Linear Slide Tongue," IP com No. IPCOM000179015D, Feb. 4, 2009; IP.com Prior Art Database, 126 pages.

Engstrand, Ola (Owner)/Välinge Innovation AB, Technical Disclosure entitled "VA043b PCT Mechanical Locking of Floor Panels," IP com No. IPCOM000189420D, Nov. 9, 2009, IP.com Prior Art Database, 62 pages.

Engstrand, Ola (Contact)/Välinge Innovation AB, Technical Disclosure entitled "VA055 Mechanical locking system for floor panels," IP com No. IPCOM000206454D, Apr. 27, 2011, IP.com Prior Art Database, 25 pages.

Engstrand, Ola (Contact)/Välinge Innovation AB, Technical Disclosure entitled "VA058 Rocker Tongue," IP com No. IPCOM000203832D, Feb. 4, 2011, IP.com Prior Art Database, 22 pages.

(56) References Cited

OTHER PUBLICATIONS

Pervan, Darko (Author)/Välinge Flooring Technology, Technical Disclosure entitled "VA066b Glued Tongue," IP com No. IPCOM000210865D, Sep. 13, 2011, IP.com Prior Art Database, 19 pages.
Pervan, Darko (Inventor)/Välinge Flooring Technology AB, Technical Disclosure entitled "VA067 Fold Slide Loc," IP com No. IPCOM000208542D, Jul. 12, 2011, IP.com Prior Art Database, 37 pages.
Pervan, Darko (Author)/Välinge Flooring Technology, Technical Disclosure entitled "VA068 Press Lock VFT," IP com No. IPCOM00208854D, Jul. 20, 2011, IP.com Prior Art Database, 25 pages.
Pervan, Darko (Author), Technical Disclosure entitled "VA069 Combi Tongue," IP com No. IPCOM000210866D, Sep. 13, 2011, IP.com Prior Art Database, 41 pages.
Pervan, Darko (Author), Technical Disclosure entitled "VA070 Strip Part," IP com No. IPCOM000210867D, Sep. 13, 2011, IP.com Prior Art Database, 43 pages.
Pervan, Darko (Author), Technical Disclosure entitled "VA071 Pull Lock," IP com No. IPCOM000210868D, Sep. 13, 2011, IP.com Prior Art Database, 22 pages.
Pervan, Darko (Author), Technical Disclosure entitled "VA073a Zip Loc," IP com No. IPCOM000210869D, Sep. 13, 2011, IP.com Prior Art Database, 36 pages.
LifeTips, "Laminate Flooring Tips," available at (http://flooring.lifetips.com/cat/61734/laminate-flooring-tips/index.html), 2000, 12 pages.
Pervan, Darko, U.S. Appl. No. 14/646,567 entitled "Mechanical Locking System for Floor Panels," filed in the U.S. Patent and Trademark Office on May 21, 2015.
Pervan, Darko, U.S. Appl. No. 14/730,691 entitled "Mechanical Locking System for Panels and Method for Installing Same," filed in the U.S. Patent and Trademark Office on Jun. 4, 2015.
Derelov, Peter, U.S. Appl. No. 14/709,913 entitled "Building Panel with a Mechanical Locking System," filed in the U.S. Patent and Trademark Office on May 12, 2015.
Pervan, Darko, U.S. Appl. No. 14/938,612, entitled "Mechanical Locking System for Floor Panels," filed in the U.S. Patent and Trademark Office on Nov. 11, 2015.
Pervan, Darko, U.S. Appl. No. 14/951,976, entitled "Mechanical Locking System for Floor Panels," filed in the U.S. Patent and Trademark Office on Nov. 25, 2015.
Pervan, Darko, U.S. Appl. No. 14/962,291, entitled "Mechanical Locking System for Floor Panels," filed in the U.S. Patent and Trademark Office on Dec. 8, 2015.
Pervan, Darko, et al., U.S. Appl. No. 15/048,252, entitled "Mechanical Locking System for Floor Panels," filed in the U.S. Patent and Trademark Office on Feb. 19, 2016.
Pervan, Darko, U.S. Appl. No. 15/148,820, entitled "Mechanical Locking System for Panels and Method of Installing Same," filed in the U.S. Patent and Trademark Office May 6, 2016.
Pervan, Darko, U.S. Appl. No. 15/160,311, entitled "Mechanical Locking System for Floor Panels," filed in the U.S. Patent and Trademark Office May 20, 2016.

* cited by examiner

KNOWN TECHNOLOGY

KNOWN TECHNOLOGY

KNOWN TECHNOLOGY

KNOWN TECHNOLOGY 34
30
34
35
35
30
35
30
34

30
21
32
31
34

30
32
34

30
34

MECHANICAL LOCKING SYSTEM FOR FLOOR PANELS

CROSS REFERENCE TO RELATED APPLICATIONS

The present application is a continuation of U.S. application Ser. No. 14/483,352, filed on Sep. 11, 2014, which is a continuation of U.S. application Ser. No. 13/585,179, filed on Aug. 14, 2012, now U.S. Pat. No. 8,857,126, which claims the benefit of U.S. Provisional Application No. 61/523,584, filed on Aug. 15, 2011. The entire contents of each of U.S. application Ser. No. 14/483,352, U.S. application Ser. No. 13/585,179, U.S. Pat. No. 8,857,126, and U.S. Provisional Application No. 61/523,584 are hereby incorporated herein by reference in their entirety.

TECHNICAL FIELD

The disclosure generally relates to the field of mechanical locking systems for floor panels and building panels and production methods to insert a tongue into a groove.

FIELD OF APPLICATION

Embodiments of the present disclosure are particularly suitable for use in floating floors, which are formed of floor panels which are joined mechanically with a locking system integrated with the floor panel, i.e. mounted at the factory, are made up of one or more upper layers of wood or wood veneer, decorative laminate, powder based surfaces or decorative plastic material, an intermediate core of wood-fibre-based material or plastic material and preferably a lower balancing layer on the rear side of the core. Floor panels with a surface layer of cork, linoleum, rubber or soft wear layers, for instance needle felt glued to a board, printed and preferably also varnished surface and floors with hard surfaces such as stone, tile and similar materials are included. Embodiments of the disclosure may also be used for joining building panels which preferably contain a board material for instance wall panels, ceilings, furniture components and similar.

The following description of known technique, problems of known systems and objects and features of the disclosure will therefore, as a non-restrictive example, be aimed above all at this field of application and in particular at panels formed as rectangular floor panels with long and shorts edges intended to be mechanically joined to each other on both long and short edges.

The long and short edges are mainly used to simplify the description of embodiments of the disclosure. The panels may be square. Embodiments of the disclosure are preferably used on the short edges. It should be emphasized that embodiments of the disclosure may be used in any floor panel and it may be combined with all types of known locking system formed on the long edges, where the floor panels are intended to be joined using a mechanical locking system connecting the panels in the horizontal and vertical directions on at least two adjacent sides.

BACKGROUND

Laminate flooring usually comprise a core of a 6-12 mm fibre board, a 0.2-0.8 mm thick upper decorative surface layer of laminate and a 0.1-0.6 mm thick lower balancing layer of laminate, plastic, paper or like material. A laminate surface comprises melamine-impregnated paper. The most common core material is fibreboard with high density and good stability usually called HDF—High Density Fibreboard. Sometimes also MDF—Medium Density Fibreboard—is used as core.

Laminate floorings are joined mechanically by means of so-called mechanical locking systems. These systems comprise locking means, which lock the panels horizontally and vertically. The mechanical locking systems are usually formed by machining of the core of the panel. Alternatively, parts of the locking system may be formed of a separate material, for instance aluminum or HDF, which is integrated with the floor panel, i.e. joined with the floor panel in connection with the manufacture thereof.

The main advantages of floating floors with mechanical locking systems are that they are easy to install. They may also easily be taken up again and used once more at a different location.

Definition of Some Terms

In the following text, the visible surface of the installed floor panel is called "front side", while the opposite side of the floor panel, facing the sub floor, is called "rear side". The edge between the front and rear side is called "joint edge". By "horizontal plane" is meant a plane, which extends parallel to the outer part of the surface layer. Immediately juxtaposed upper parts of two adjacent joint edges of two joined floor panels together define a "vertical plane" perpendicular to the horizontal plane. By "vertical locking" is meant locking parallel to the vertical plan. By "horizontal locking" is meant locking parallel to the horizontal plane.

By "up" is meant towards the front side, by "down" towards the rear side, by "inwardly" mainly horizontally towards an inner and center part of the panel and by "outwardly" mainly horizontally away from the center part of the panel.

By "locking systems" are meant co acting connecting elements, which connect the floor panels vertically and/or horizontally.

Related Art and Problems Thereof

For mechanical joining of long edges as well as short edges in the vertical and in the first horizontal direction perpendicular to the edges several methods may be used. One of the most used methods is the angle-snap method. The long edges are installed by angling. The panel is than displaced in locked position along the long side. The short edges are locked by horizontal snapping. The vertical connection is generally a tongue and a groove. During the horizontal displacement, a strip with a locking element is bent and when the edges are in contact, the strip springs back and a locking element enters a locking groove and locks the panels horizontally. Such a snap connection is complicated since a hammer and a tapping block may need to be used to overcome the friction between the long edges and to bend the strip during the snapping action.

Similar locking systems may also be produced with a rigid strip and they are connected with an angling-angling method where both short and long edges are angled into a locked position.

Recently new and very efficient locking systems have been introduced with a separate flexible or displaceable integrated tongue on the short edge that allows installation with only an angling action, generally referred to as "vertical folding". Such a system is described in WO 2006/043893 (Valinge Innovation AB).

Several versions are used on the market. One of the most used versions is shown in FIGS. 1*a*-1*d*. A flexible tongue 30 is during locking displaced in a horizontally extending displacement groove 40 and into a tongue groove 20 of an adjacent panel. The displaceable tongue locks the edges vertically and a strip 6 with a locking element that cooperates with a locking groove 14 locks the panels horizontally. The locking is a combination of vertical displacement and turning similar to a scissor action. The tongue is gradually displaced inwardly during locking from one inner edge to an outer edge as shown in FIG. 1*d* such that the tongue is bent in the length direction. Such systems are referred to as vertical snap systems and they provide an automatically locking during the folding action.

Although such systems are very efficient, there is still a room for improvements.

High locking force can only be accomplished with high snapping resistance when the tongue is pressed inwardly and bent in the length direction. This creates separation forces that tend to push the panels apart during folding. The locking may lose its strength if the flexibility and pressing force of the tongue decreases over time.

The flexibility must be considerable and allow that a flexible tongue is displaced in two directions about 1-2 mm. The material, which is used to produce such tongues, is rather expensive and glass fibres are generally used to reinforce the flexible tongue.

It would be a major advantage if snapping could be eliminated in a system that locks automatically during folding.

SUMMARY AND OBJECTS

An overall objective of embodiments of the present disclosure is to provide a locking system for primarily rectangular floor panels with long and short edges installed in parallel rows, which allows that the short edges may be locked to each other automatically without a snap action that creates a locking resistance and separation forces of the short edges during folding.

A specific objective is to provide a locking system with a separate displaceable tongue that may be bent in length direction with a lower separation force and that comprises means that prevent the tongue to slide back into the groove after locking.

The above objects of embodiments of the disclosure may be achieved wholly or partly by locking systems and floor panels according to the disclosure. Embodiments of the disclosure are evident from the description and drawings.

An aspect of the disclosure is building panels provided with a locking system for vertical locking of a first and a second building panel by a vertical displacement of the panels relative each other. A displaceable tongue is attached into a sidewardly open displacement groove provided at an edge of the first panel. Said tongue cooperates with a tongue groove provided at an adjacent edge of the second panel for locking the edges vertically. A strip protrudes below the displacement groove and outwardly beyond the upper part of the edge or below the tongue groove and outwardly beyond the upper part of the adjacent edge. The displaceable tongue comprises a pulling extension at its outer part configured to cooperate with a pulling protrusion formed at an edge of the adjacent panel such that the displaceable tongue is pulled out from the displacement groove and into the tongue groove when the edges of the panels are displaced vertically against each other.

Said pulling protrusion may be part of the tongue groove.

The pulling extension may be inclined in relation to a main horizontal plane of the panels.

The pulling protrusion may be inclined in relation to a main horizontal plane of the panels.

The displaceable tongue may be provided with a locking hook that prevents the tongue to slide back into the displacement groove after locking.

The locking hook may lock against an outer part of the displacement groove.

BRIEF DESCRIPTION OF THE DRAWINGS

The disclosure will in the following be described in connection to exemplary embodiments and in greater detail with reference to the appended exemplary drawings, wherein.

DETAILED DESCRIPTION OF EMBODIMENTS

To facilitate understanding, several locking systems in the figures are shown schematically. It should be emphasized that improved or different functions may be achieved using combinations of the embodiments.

All embodiments may be used separately or in combinations. Angles, dimensions, rounded parts, spaces between surfaces etc. are only examples that may be adjusted within the basic principles of the disclosure.

Figure 1A:
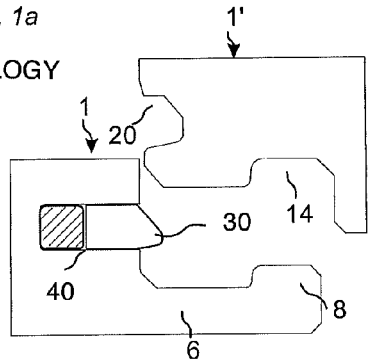
FIGS. 1*a*-*d* illustrate locking systems according to known technology.
Figure 1B:
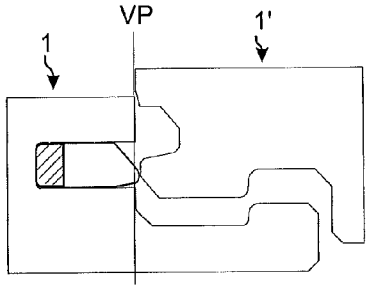
Figure 1C:
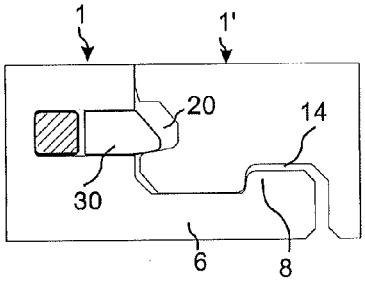
Figure 1D:
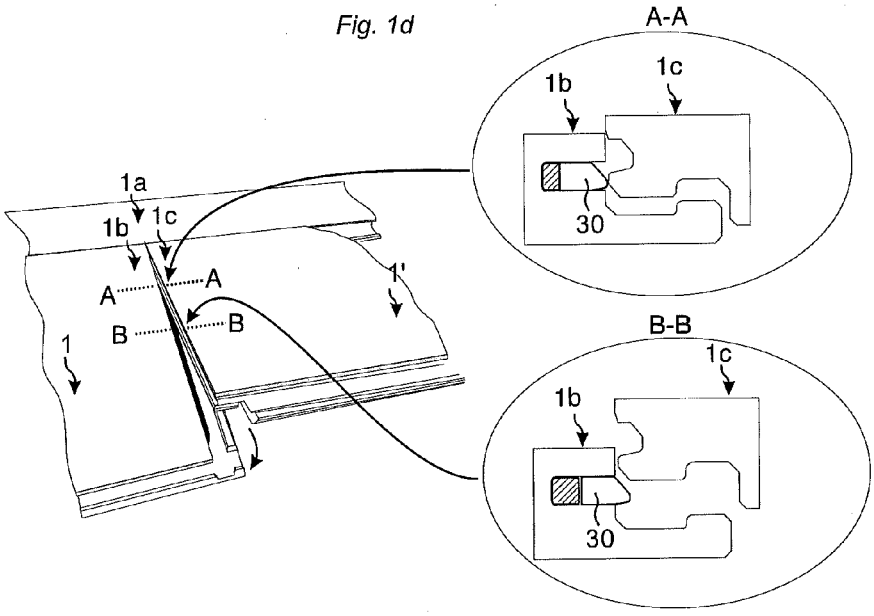
Figure 2A:
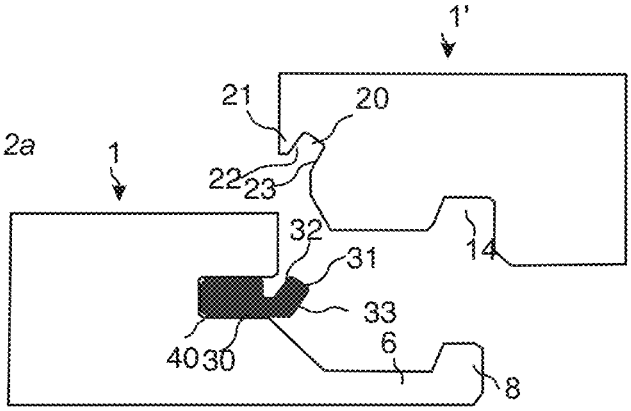
FIGS. 2*a*-*e* illustrate a short edge locking system according to the disclosure.
Figure 2B:
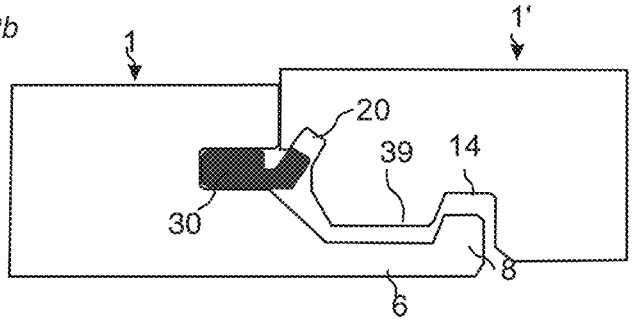
Figure 2C:
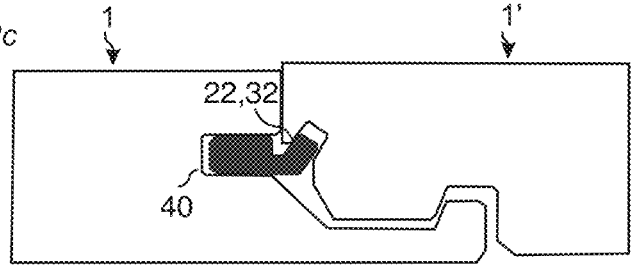
Figure 2D:
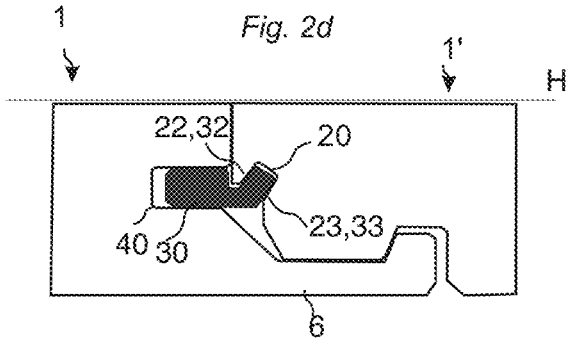
Figure 2E:
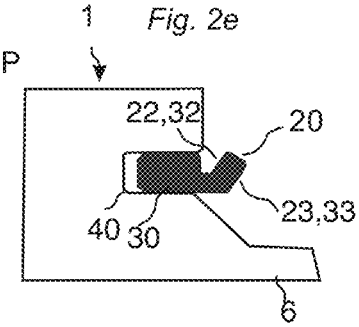

FIGS. 2*a*-2*e* show a first preferred embodiment of a short edge locking system provided with a flexible and displaceable tongue 30 in an edge of a first panel 1 inserted in a horizontally extending displacement groove 40. The displaceable tongue 30 has a pulling extension 31 comprising a tongue pulling surface 32 and tongue locking surface 33. The second adjacent panel 1' has a pulling protrusion 21 with a groove pulling surface 22 that is also a part of a tongue groove 20 comprising a groove locking surface 23. The pulling surfaces 22, 32 cooperate during the vertical displacement and pull the displaceable tongue 30 into a tongue groove 20. The pulling extension 31 comprises a tongue locking surface 33 that locks against a groove locking surface 23 and prevents vertical displacement of the edges in a first vertical direction. A locking strip 6 and a lower part 39 of the adjacent panel locks the edges in a second vertical direction. A locking element 8 and a locking groove 14 locks the edges horizontally together with the upper edges. The vertical connection may be used without the horizontal locking as shown by FIG. 2*e*. Short edges may be locked horizontally by, for example, friction between long edges.

Figure 3A:
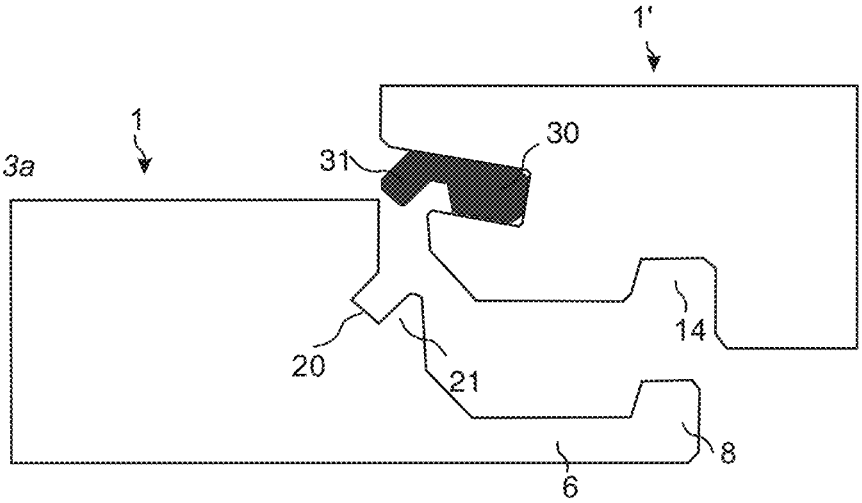
FIGS. 3*a*-3*c* illustrate a short edge locking system according to preferred embodiments of the disclosure.
Figure 3B:
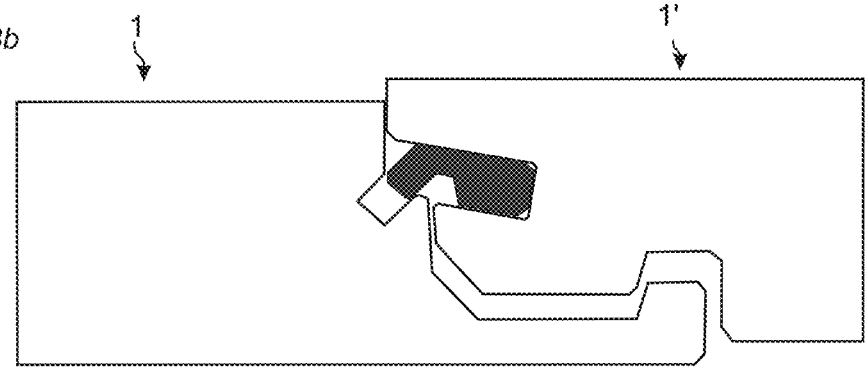
Figure 3C:
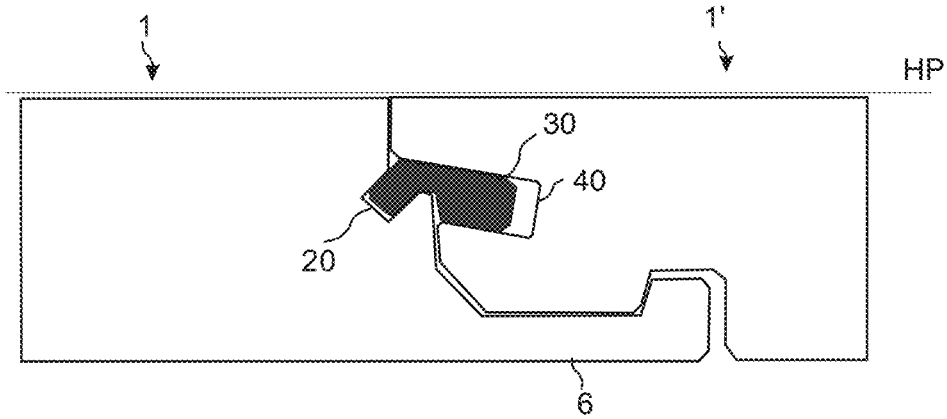

The tongue may be attached into a displacement groove 40 formed on the panel comprising the strip 6, the strip panel, or on the panel comprising the locking groove, the groove panel, as shown in FIGS. 3*a*-3*c*. The pulling protrusion 21 may extend upwardly or downwardly and the displacement groove may be inclined against the horizontal plane HP.

Figure 4A:
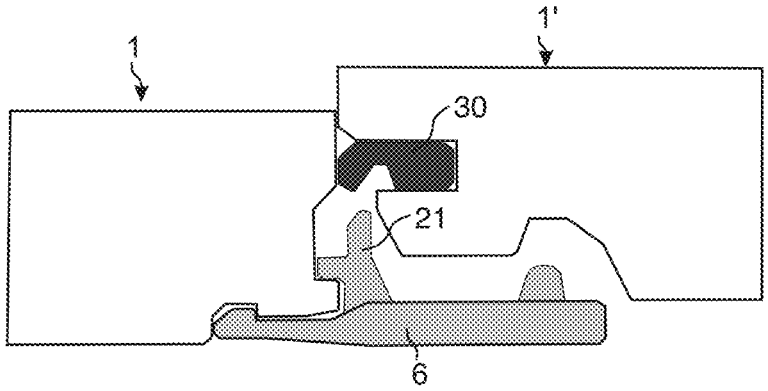
FIGS. 4*a*-*c* illustrate preferred embodiments of short edge locking systems with a separate strip.
Figure 4B:
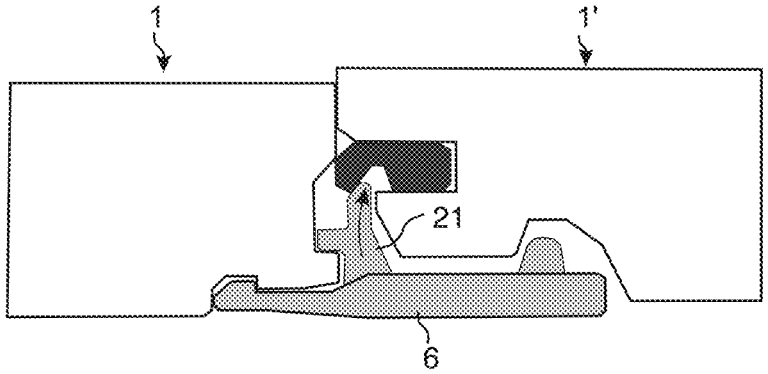
Figure 4C:
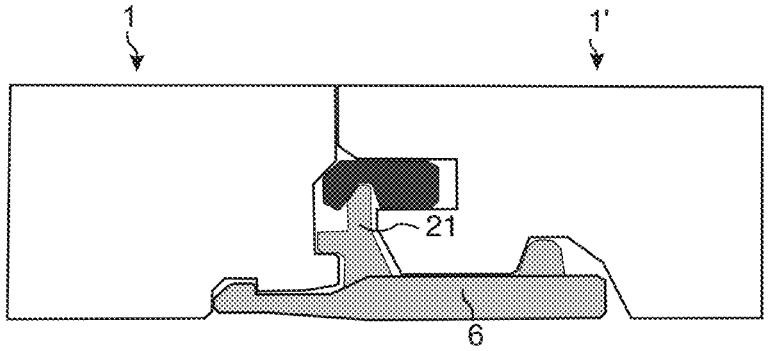

FIGS. 4*a*-4*c* show that the strip 6 may be formed as a separate material. The pulling protrusion 21 may be flexible and this may eliminate production tolerances and facilitate the displacement of the tongue 30 into the tongue groove 20 during folding.

Figure 5A:
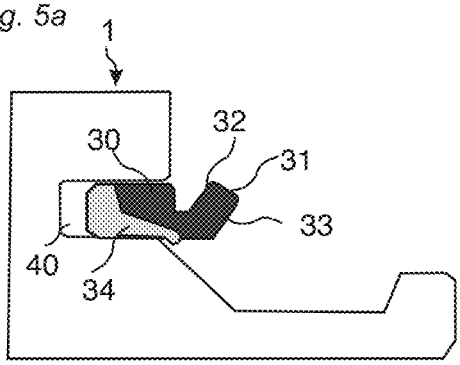
FIGS. 5*a*-*e* illustrate a locking system according to an embodiment of the disclosure with a locking hook that prevents unlocking.
Figure 5B:
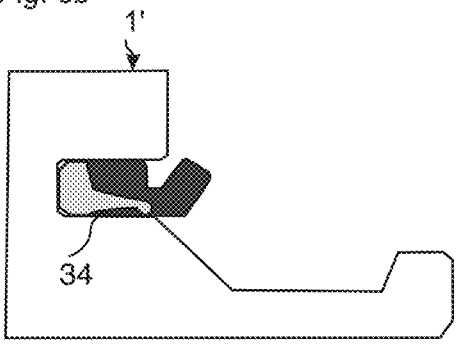
Figure 5C:
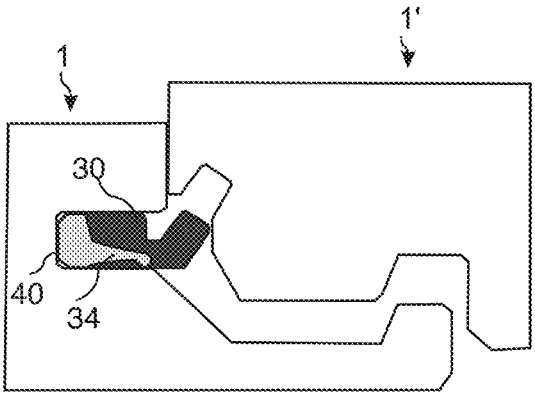
Figure 5D:
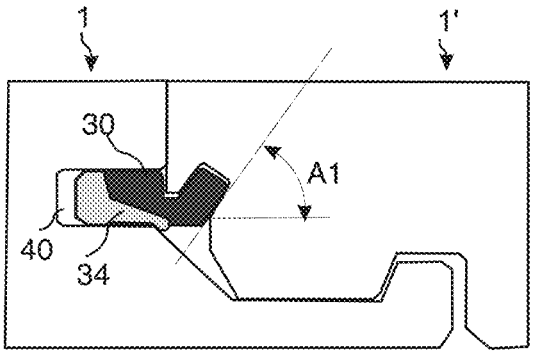
Figure 5E:
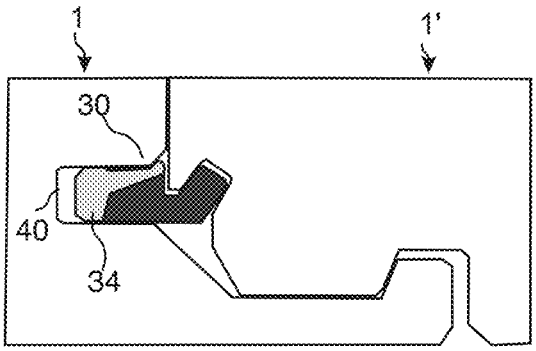

FIGS. 5*a*-5*e* show that the displaceable tongue 30 may comprise a locking hook 34 that may serve as a friction connection to prevent the tongue 30 from falling out from the groove 40 but also to prevent the tongue from sliding back after locking. The locking angle A1 is preferably about 45 degrees or higher. A higher angle facilitates displacement into the tongue groove 20 but also backward displacement. This may be prevented by a hook connection 34 that preferably locks against an upper or lower part of the displacement groove 40. The hook connection is pressed into the groove by a hammer that inserts the tongue 30 into the groove 40 during production. The hook 34 slides against a bevel formed at the displacement groove 40 as shown in FIG. 5*c*. The upper part of the locking element 8 is preferably located vertically below the tongue locking surface 33 as shown in FIG. 5*d*. This gives a stronger locking. The locking system may have a geometry that allows locking and unlocking with angling.

Figures 6A, 6B, 6C, 6D:
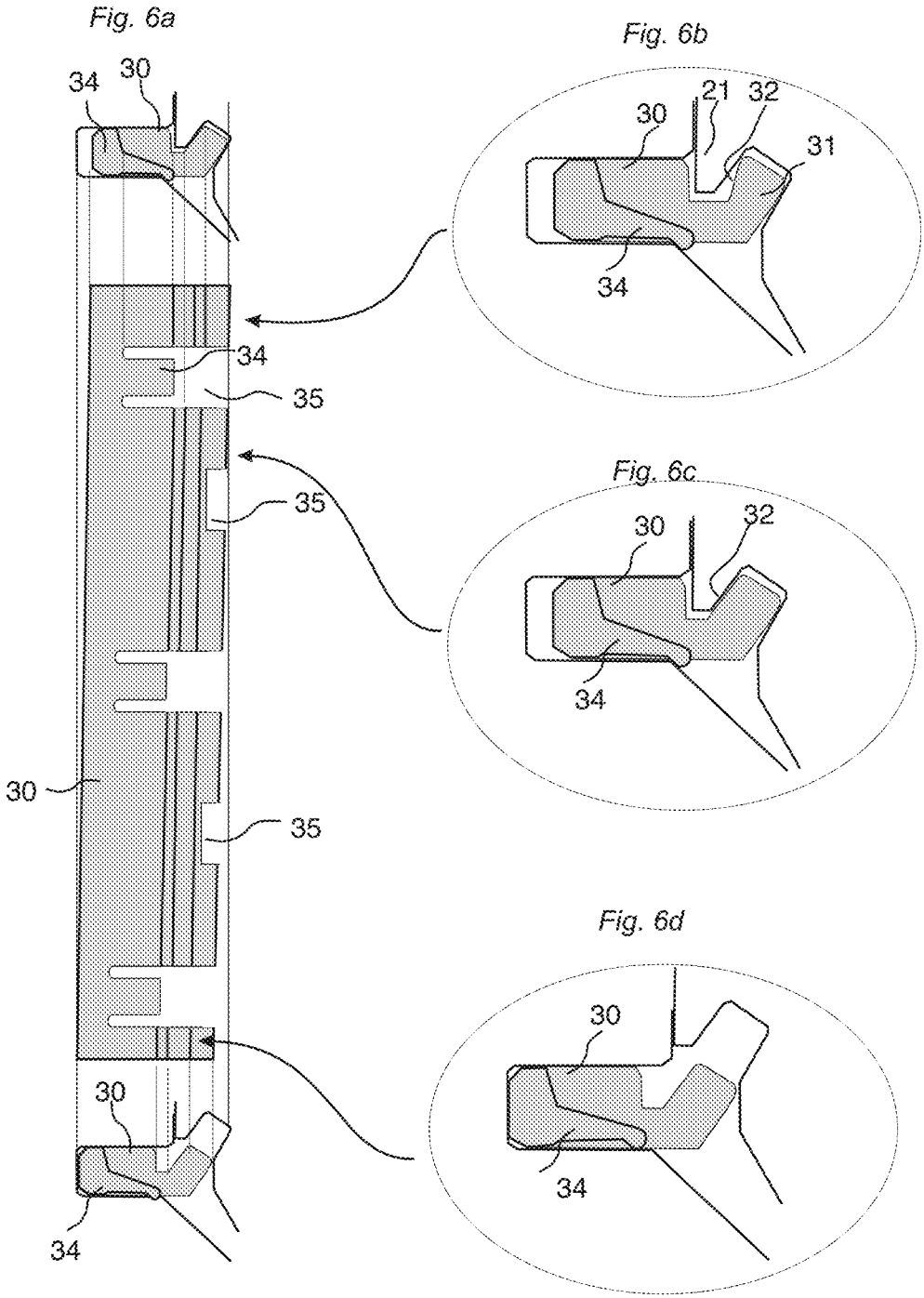
FIGS. 6*a*-*d* illustrate a tongue according to an embodiment of the disclosure with increased flexibility related to bending in length direction.
Figure 7A:
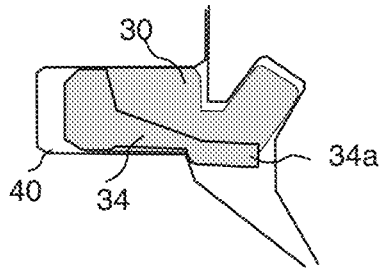
FIGS. 7*a*-*d* illustrate a method according to an embodiment of the disclosure to insert a tongue into a groove.
Figure 7B:
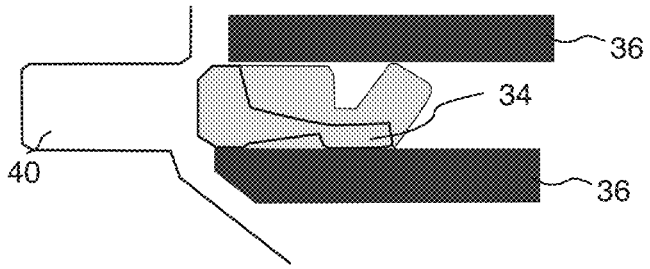
Figure 7C:
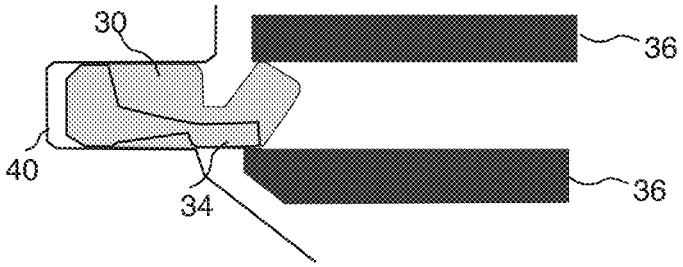
Figure 7D:
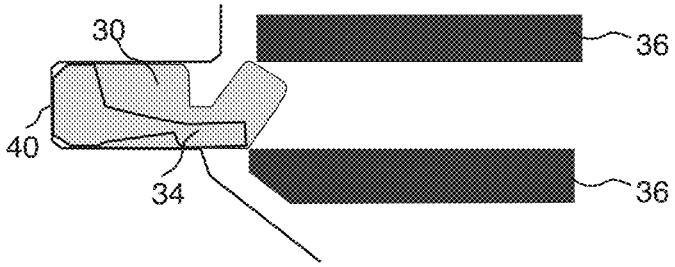

FIGS. 6*a*-6*c* show that the displaceable tongue 30 turns and bends in the length direction during folding when an inner short edge of the tongue, as shown in FIG. 6*b* is in locked position and an outer short edge of the tongue 30 is in unlocked position as shown in FIG. 6*d*. The locking function may be improved if cavities 35 are formed on the displaceable tongue 30. Locking may also be improved if the locking surface 32 at an edge has a lower angle than at an inner part as shown in FIGS. 6*b* and 6*c*. The cavities 35 may be formed at tongue section where the locking hooks 34 are formed. The displaceable tongue 30 comprises preferably a polymer material and is preferably formed by injection molding.

FIGS. 7*a*-7*d* show that the locking hook 34 may comprise a hook part 34*a* that is used to press the hook connection upwards by inserting rails 36 during the insertion of the tongue 30 into the displacement groove 40.

Figure 8A:
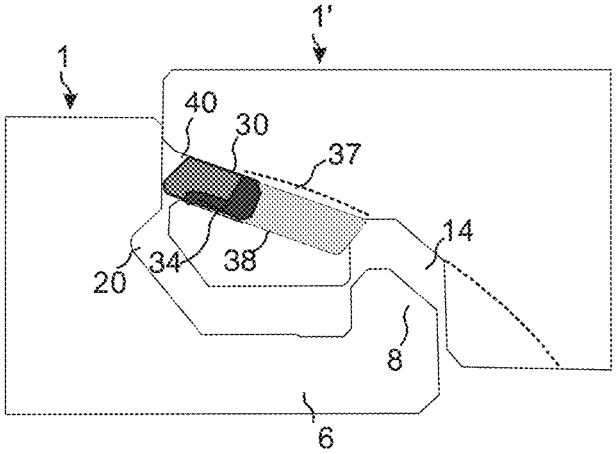
FIGS. 8*a*-*c* illustrate an embodiment of the disclosure.
Figure 8B:
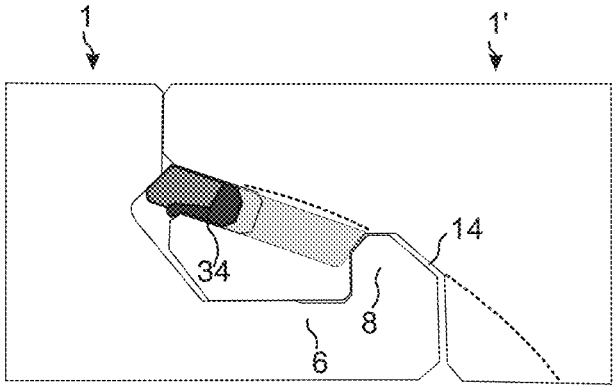
Figure 8C:
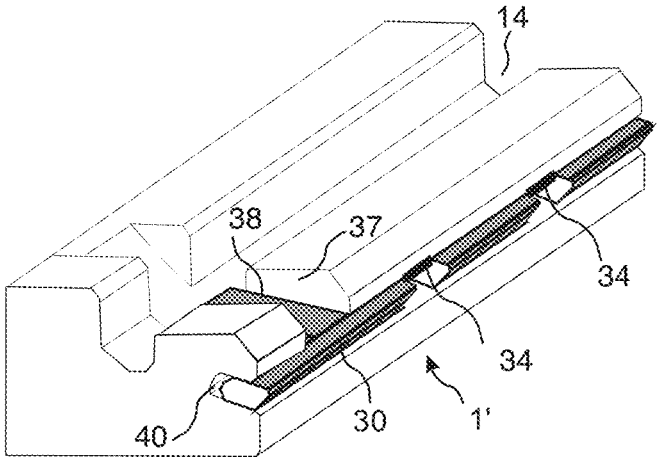

FIGS. 8*a*-8*c* show that the locking hook 34 may be used to prevent unlocking in any locking system where a tongue is displace in a groove from an inner position to an outer position. The shown locking system comprises pushing protrusions 38 located in pushing cavities 37. The pushing protrusions slide against the locking element 8 and push the tongue 30 into a tongue groove 20. The locking element 8 is preferably located vertically below the cooperating locking surfaces 23,33 of the tongue 30 and the tongue groove 20.

The invention claimed is:

1. Building panels comprising:

a first building panel;

a second building panel; and a displaceable tongue arranged in a sidewardly open displacement groove provided at an edge of the first building panel, wherein the displaceable tongue comprises a pulling extension configured to cooperate with a pulling protrusion formed at an adjacent edge of the second building panel such that the displaceable tongue is pulled out from the sidewardly open displacement groove and into a tongue groove provided at the adjacent edge of the second building panel when the edge of the first building panel and the adjacent edge of the second building panel are displaced vertically relative to each other, and wherein the displaceable tongue is configured to bend in a length direction of the displaceable tongue.

2. Building panels as claimed in claim 1, wherein a part of said pulling protrusion is a part of the tongue groove.

3. Building panels as claimed in claim 1, wherein the pulling extension and the pulling protrusion are inclined in relation to a main horizontal plane of the first and second building panels.

4. Building panels as claimed in claim 1, wherein the displaceable tongue comprises a locking hook that prevents the displaceable tongue from sliding back into the displacement groove after locking.

5. Building panels as claimed in claim 4, wherein the locking hook locks against an outer part of the sidewardly open displacement groove.

6. Building panels as claimed in claim 1, wherein the first and second building panels are floor panels.

7. Building panels as claimed in claim 1, wherein the displaceable tongue is configured to bend when an inner short edge of the displaceable tongue is in a locked position and an outer short edge of the displaceable tongue is in an unlocked position.

8. Building panels as claimed in claim 1, wherein the displaceable tongue is configured to bend during a folding action.

9. Building panels as claimed in claim 1, wherein the displaceable tongue is configured to cooperate with the tongue groove for locking the edge of the first building panel and the adjacent edge of the second building panel vertically.

10. Building panels as claimed claim 1, further comprising a strip that protrudes:

below the displacement groove and outwardly beyond an upper part of the edge of the first building panel; or below the tongue groove and outwardly beyond an upper part of the adjacent edge of the second building panel.

11. Building panels as claimed in claim 10, wherein an upper part of a locking element of the first building panel is located vertically below a tongue-locking surface of the pulling extension, wherein the locking element is configured to cooperate with a locking groove of the second building panel for horizontal locking of the first and second building panels.

12. Building panels as claimed in claim 1, wherein the pulling extension is provided at an outer part of the displaceable tongue.

13. Building panels as claimed in claim 1, wherein the displaceable tongue is a separate displaceable tongue.

14. Building panels as claimed in claim 1, wherein the displaceable tongue is formed by injection moulding.

* * * * *